US010401002B2

(12) United States Patent
Xu et al.

(10) Patent No.: US 10,401,002 B2
(45) Date of Patent: Sep. 3, 2019

(54) LED LAMP AND LED LIGHT SOURCE MODULE THEREOF

(71) Applicant: OPPLE LIGHTING CO., LTD., Shanghai (CN)

(72) Inventors: Zhengwang Xu, Jiangsu (CN); Songjing Jiang, Jiangsu (CN); Shitao Deng, Jiangsu (CN); RuiKai Lian, Jiangsu (CN)

(73) Assignee: OPPLE LIGHTING CO., LTD., Shanghai (CN)

( * ) Notice: Subject to any disclaimer, the term of this patent is extended or adjusted under 35 U.S.C. 154(b) by 308 days.

(21) Appl. No.: 15/463,916

(22) Filed: Mar. 20, 2017

(65) Prior Publication Data

US 2017/0191642 A1 Jul. 6, 2017

Related U.S. Application Data

(63) Continuation of application No. PCT/CN2015/072968, filed on Feb. 13, 2015.

(30) Foreign Application Priority Data

Sep. 22, 2014 (CN) ..... 2014 1 0487526
Jan. 7, 2017 (CN) ..... 2017 1 0026605

(51) Int. Cl.
*F21V 17/10* (2006.01)
*F21V 23/02* (2006.01)
(Continued)

(52) U.S. Cl.
CPC ..... *F21V 17/105* (2013.01); *F21V 5/007* (2013.01); *F21V 17/16* (2013.01); *F21V 23/003* (2013.01);
(Continued)

(58) Field of Classification Search
CPC ..... F21V 15/01; F21V 17/105; F21V 29/507
See application file for complete search history.

(56) References Cited

U.S. PATENT DOCUMENTS 7,338,189 B2 * 3/2008 Kovacik ..... F21L 14/023 362/196
8,651,711 B2 * 2/2014 Rudisill ..... F21S 2/005 362/398
(Continued)

FOREIGN PATENT DOCUMENTS

CN 202012828 U 10/2011
CN 102410462 A 4/2012
(Continued)

OTHER PUBLICATIONS

International Search Report issued in corresponding PCT Application No. PCT/CN2015/072968, dated Jun. 17, 2015, 7 pages.

*Primary Examiner* — Andrew J Coughlin
(74) *Attorney, Agent, or Firm* — Arch & Lake LLP

(57) ABSTRACT

An LED light source module is provided and includes: a light source plate that has a first surface and a second surface opposite to each other, where several LED light sources are attached on the first surface; a power driving module, configured to be electrically connected to the light source plate; and an integrated lens assembly, fixed on the light source plate and having several lens units respectively capped outside the corresponding LED light sources, where the integrated lens assembly is configured to have an accommodating space and the power driving module is accommodated in the accommodating space, and magnetic elements and/or mechanical connecting elements are assembled into the integrated lens assembly and run through the light source plate and are adsorbed and/or assembled on the base.

21 Claims, 7 Drawing Sheets

(51) Int. Cl.

| | |
|---|---|
| ***F21V 17/16*** | (2006.01) |
| ***F21V 5/00*** | (2018.01) |
| ***F21V 23/00*** | (2015.01) |
| *F21Y 115/10* | (2016.01) |
| *F21V 15/01* | (2006.01) |
| *F21Y 105/18* | (2016.01) |

(52) U.S. Cl.
CPC ..... *F21V 23/006* (2013.01); *F21V 23/02* (2013.01); *F21V 15/01* (2013.01); *F21Y 2105/18* (2016.08); *F21Y 2115/10* (2016.08)

(56) References Cited

U.S. PATENT DOCUMENTS

| | | | | |
|---|---|---|---|---|
| 10,068,442 | B2 * | 9/2018 | Chong | G08B 7/066 |
| 2008/0298056 | A1 * | 12/2008 | Petersen | F21V 5/007 362/235 |
| 2011/0043120 | A1 * | 2/2011 | Panagotacos | B64D 47/04 315/224 |
| 2013/0329434 | A1 * | 12/2013 | Packard | F21V 19/04 362/311.01 |
| 2017/0164439 | A1 * | 6/2017 | Reed | F21V 9/40 |
| 2017/0254516 | A1 * | 9/2017 | Zhu | F21V 17/10 |

FOREIGN PATENT DOCUMENTS

| | | | |
|---|---|---|---|
| CN | 202216103 | U | 5/2012 |
| CN | 202501258 | U | 10/2012 |
| CN | 103094268 | A | 5/2013 |
| JP | 2009-021203 | A | 1/2009 |
| JP | 2009-21203 | A | 1/2009 |

* cited by examiner

LED LAMP AND LED LIGHT SOURCE MODULE THEREOF

CROSS-REFERENCE TO RELATED APPLICATIONS

This application is based upon and claims the priority of PCT patent application No. PCT/CN2015/072968 filed on Feb. 13, 2015 which claims the priority of Chinese Patent Application No. 2014104875267 filed on Sep. 22, 2014, and the priority of Chinese Patent Application No. 2017100266051 filed on Jan. 7, 2017, the entire contents of all of which are hereby incorporated by reference herein for all purposes.

TECHNICAL FIELD

The present disclosure relates to the field of light sources, in particular, to a light-emitting diode (LED) lamp and an LED light source module thereof.

BACKGROUND

LED light sources involve a new kind of light sources and have the advantages such as long service life, low power consumption, non-radiation, being free of harmful substances such as mercury, and so on. Lamps taking LED light sources as main light sources have been more and more in the market. The LED light sources are gradually replacing the traditional light sources, become the important light sources in the lighting field, and are widely applied in various fields of life and production.

A plurality of LED units are usually integrated onto a printed circuit board (PCB), and a separate lens unit respectively covers each LED unit. The means that a plurality of lens units are respectively arranged on a light source plate, which wastes time and work and also cannot guarantee quality. Moreover, the arrangement of the separate lens units also requires a protecting cover that is additionally arranged to protect circuits on parts of the light source plate, which part is not covered by the lens units, so the manufacturing process is relatively complex.

In addition, the assembly of LED light sources into a lamp is a necessary process in the manufacturing process, and the assembly efficiency also affects the cost of the lamp. The fixing means mostly directly employs screws to fix a light source module on a base. The fixing means is inconvenient in the assembly and disassembly process. There is also disclosed a structure adopting magnetic connecting elements to adsorb the entire lamp onto a fixing mechanism. Although the convenience in the assembly process is improved to some extent, the structure still suffers from the risk of disengagement of the magnetic elements and the lamp.

Therefore, an LED lamp having the advantages of simple manufacturing process, easy assembly, safety and reliability and an LED light source module applied in the LED lamp are required.

SUMMARY

An objective of the present disclosure is to provide an LED lamp and an LED light source module applied in the LED lamp.

The first aspect of the present disclosure discloses an LED light source module. The module may include: a light source plate comprising a first surface and a second surface which are opposite to each other, in which a plurality of LED light sources are attached to the first surface, and the second surface faces a base assembled on a mounting base; a power driving module electrically connected with the light source plate; and an integrated lens assembly configured to be fixed with the light source plate. The integrated lens assembly may cover an outside of the first surface of the light source plate, and may be provided with a plurality of lens units which may respectively cover an outside of corresponding LED light sources, and may be provided with an accommodating space which may be configured to accommodate the power driving module into the accommodating space.

The second aspect of the present disclosure discloses an LED lamp light source module, disposed in an LED lamp and used for lighting. The module may include a light source plate including a first surface and a second surface which are opposite to each other, in which a plurality of LED light sources are attached to the first surface, and the second surface faces a base assembled on a mounting base of the LED lamp; a power driving module electrically connected with the light source plate; and an integrated lens assembly configured to be fixed with the light source plate.

Further, the module may include at least two magnetic elements assembled into the integrated lens assembly, in which the integrated lens assembly is at least partially bonded to and covers an outside of the first surface of the light source plate and is provided with a plurality of lens units which respectively cover an outside of corresponding LED light sources; the integrated lens assembly may be provided with an accommodating space, and the power driving module is accommodated into the accommodating space; the integrated lens assembly is provided with accommodating portions which are extended towards the light source plate and run through the light source plate; and the at least two magnetic elements are at least partially accommodated into the accommodating portions.

It should be understood that both the foregoing general description and the following detailed description are only exemplary and explanatory and are not restrictive of the disclosure.

BRIEF DESCRIPTION OF THE DRAWINGS

The accompanying drawings herein which are incorporated into and constitute a part of the description, illustrate the embodiments according to the present disclosure, and serve to explain the principles of the present disclosure together with the description.

Figure 1:
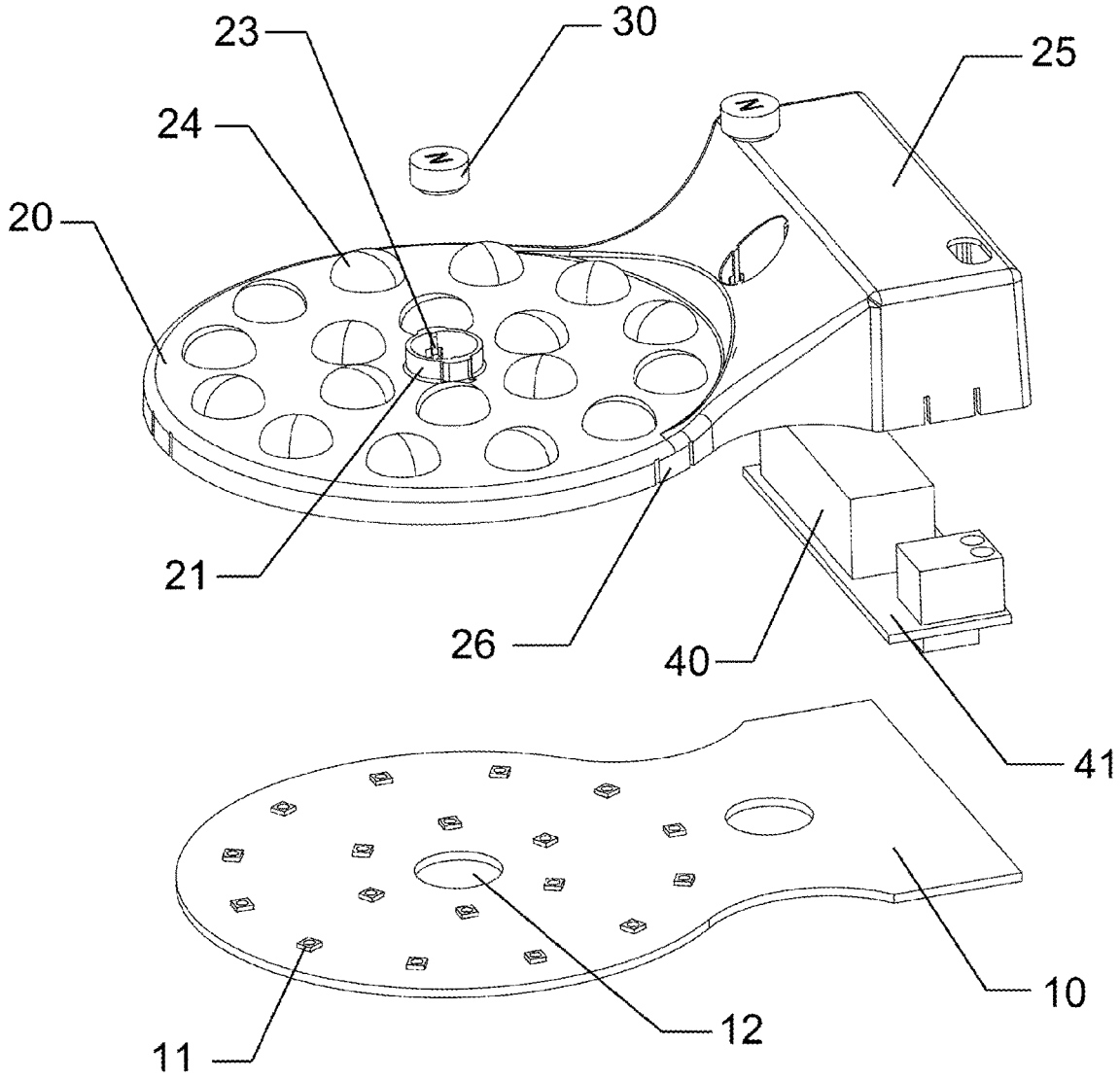
FIG. 1 is a schematic exploded view of an LED light source module provided by a first preferred embodiment of the present disclosure.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various examples of the present disclosure. Also, common but well-understood elements that are useful or necessary in a commercially feasible example are often not depicted in order to facilitate a less obstructed view of these various examples. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above, except where different specific meanings have otherwise been set forth herein.

DETAILED DESCRIPTION

Further description will be given below to the advantages of the present disclosure with reference to the accompanying drawings and the preferred embodiments.

Reference will now be made in detail to certain embodiments, examples of which are illustrated in the accompanying drawings. The following description refers to the accompanying drawings in which the same numbers in different figures represent the same or similar elements unless otherwise indicated. The implementations set forth in the following description of embodiments do not represent all implementations consistent with the disclosure. Instead, they are merely examples of devices and methods consistent with aspects related to the disclosure as recited in the appended claims.

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," etc. may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

Reference throughout this specification to "one embodiment," "an embodiment," "exemplary embodiment," or the like in the singular or plural means that one or more particular features, structures, or characteristics described in connection with an example is included in at least one embodiment of the present disclosure. Thus, the appearances of the phrases "in one embodiment" or "in an embodiment," "in an exemplary embodiment," or the like in the singular or plural in various places throughout this specification are not necessarily all referring to the same embodiment. Furthermore, the particular features, structures, or characteristics in one or more embodiments may be combined in any suitable manner.

Reference numerals in the accompanying drawings:
10—light source plate, 11—LED light source, 12—through hole, 13—clamping hole; 20—integrated lens assembly, 21—accommodating portion, 22—free end, 23—fastening stand, 24—hemispherical lens, 25—accommodating space, 26—elastic fastener, 27—elastic jaw, 28—incident surface, 29—light-emitting surface; 30—magnetic element; 40—power driving module, 41—adapter plate.

FIGS. 1 to 7 illustrate two preferred embodiments of the LED light source module provided by the present disclosure. The LED light source module comprises a light source plate 10, an integrated lens assembly 20, magnetic elements 30, and a power driving module 40. The light source plate 10 has a first surface and a second surface which are opposite to each other; a plurality of LED light sources 11 are attached to the first surface; the second surface faces a base (not shown) assembled on a mounting base; the power driving module 40 is electrically connected with the light source plate 10; and the integrated lens assembly 20 is fixed with the light source plate 10. In the present disclosure, the integrated lens assembly 20 and the light source plate 10 are fixed by a detachable connection mechanism, and the light source plate 10 is fastened through a plurality of fasteners or hooks disposed on the integrated lens assembly 20, so that complete assembly can be achieved. Of course, the present disclosure may still adopt other assembly methods, for instance, an undetachable connection mechanism such as gluing and welding, to realize the fixing of the integrated lens assembly 20 with the light source plate 10; in this way, no matter detachable connection mechanism or undetachable connection mechanism is adopted, the technical proposals shall all fall within the scope of protection of the present disclosure as long as the fixing effect of complete assembly of the integrated lens assembly 20 with the light source plate 10 is achieved and the luminous effect of the entire LED light source module is not disadvantageously affected.

Preferably, in the present disclosure, the integrated lens assembly 20 covers the outside of the first surface of the light source plate 10 and is provided with a plurality of lens units (e.g., hemispherical lenses 24) which respectively cover the outside of LED light sources 11; the integrated lens assembly 20 is provided with an accommodating space 25; and the power driving module 40 is accommodated within the accommodating space 25. In general, the integrated lens assembly 20 is made from an insulating material, preferably one of polycarbonate (PC), Acrylic or polymethyl methacrylate (PMMA). The three kinds of materials have the advantages of light weight, low cost and high transmittance and are relatively ideal materials taken as light guide components. As the power driving module 40 is accommodated into the accommodating space 25, the power driving module 40 can be insulated from the outside space through the integrated lens assembly 20, and the integrated lens assembly 20 is taken as a protecting cover and configured to protect the power driving module 40. In the present disclosure, the integrated lens assembly 20 receives emergent light of the light source plate 10. By adoption of the LED light sources 11 and the hemispherical lenses 24 which are arranged in one-to-one correspondence, the emergent light is refracted by the hemispherical lenses 24 and emitted to form scattered luminous spots, so that the function of lighting can be achieved.

In the two preferred embodiments, the integrated lens assembly 20 is equipped with a lens setting area provided with the plurality of hemispherical lenses 24 and a power supply accommodating area provided with the accommodating space 25 and configured to accommodate the power driving module 40; the lens setting area is disposed at the first height of the integrated lens assembly 20; and the power supply accommodating area is formed with being projected upwards from the first height, and a top surface of the power supply accommodating area is disposed at the second height. Due to the lens setting area and the power supply accommodating area with different heights, the integrated lens assembly 20 is L-shaped as a whole, and the power supply accommodating area higher than the lens setting area provides convenience to form the accommodating space 25 to accommodate the power driving module 40. The power supply accommodating area extends outward to integrally form a tail portion 253, and the height of the tail portion is lower than the second height where the power supply accommodating area is provided.

The tail portion 253 may be configured to allow a wire to pass therethrough and clamp the wire so as to prevent the wire electrically connected with the power driving module from being electrically disconnected from the power driving module because of pulling. The tail portion 253 is overlapped with the light source plate 10 and provided with two openings 2530, which allow screws to pass therethrough to clamp the wire between the integrated lens assembly 20 and the light source plate 10. Close to the tail portion 253, the integrated lens assembly 20 is provided with an notch 252 and the light source plate 10 is provided with a notch 10 which is open upward and downward. The notches 252, 14 are configured to allow the wire to be electrically connected with an external power source by passing through the light source plate 10 from the integrated lens assembly 20.

Preferably, corresponding to the integrated lens assembly 20, the light source plate 10 is provided with a light source setting area provided with the plurality of LED light sources and a power supply area configured to mount the power driving module 40. The lens setting area covers the light source setting area, and the power supply area and the power supply accommodating area accommodate the power driving module 40 together. In the first preferred embodiment, the power supply accommodating area is disposed on one side of the lens setting area, and correspondingly the power supply area is disposed on one side of the light source setting area. In the second preferred embodiment, the power supply accommodating area is disposed in the middle part of the lens setting area, and correspondingly the power supply area is disposed in the middle part of the light source setting area. In the two optional preferred embodiments, both the two positions do not affect the luminous effect of the lamp, and the insulating effect of the power driving module 40 is also pretty good.

In the two preferred embodiments, a plurality of magnetic elements 30 and/or mechanical connecting elements (not shown, for example screws, in which case the integrated lens assembly 20 and the light source plate 10 are correspondingly provided with screw holes (not shown in the figure)) run through the integrated lens assembly 20 and the light source plate 10, and are adsorbed and/or assembled onto the base. Preferably, the plurality of magnetic elements 30 and/or mechanical connecting elements are concentrically spaced on a central portion and/or a body portion and/or an edge portion of the integrated lens assembly 20; and the light source plate 10 is correspondingly provided with through holes 12 with a shape matching with the magnetic elements 30 and/or the mechanical connecting elements to run there through and thus be fixed.

In the first preferred embodiment, two magnetic elements 30 are respectively disposed at the central portion of the lens setting area and the central portion of the junction between the lens setting area and the power supply accommodating area; and the two magnetic elements 30 respectively fix the lens setting area and the power supply accommodating area. In the second preferred embodiment, three magnetic elements 30 are approximately distributed in a triangle, and the fixing effect can become better by utilization of the stability of the triangle.

The integrated lens assembly 20 includes a plurality of accommodating portions 21. The accommodating portions 21 are extended towards the light source plate 10 from the integrated lens assembly 20. Correspondingly, the light source plate 10 is provided with a plurality of through holes 12. The through holes 12 and the accommodating portions 21 are arranged correspondingly and have shapes matching each other, namely the accommodating portions 21 and the through holes 12 are in the same number; the accommodating portion 21 can just run through the through hole 12; and an outer wall of the accommodating portion 21 and an inner wall of the through hole 12 generate frictional contact therebetween. One magnetic element 30 is fixed in each accommodating portion 21; and meanwhile, the base of the lamp can adsorb the magnetic elements 30 disposed in the accommodating portions 21, and the accommodating portion 21 is attracted to the magnetic base as well. In this way, the integrated lens assembly 20 and the light source plate 10 are fixed on the magnetic base.

Figure 2:
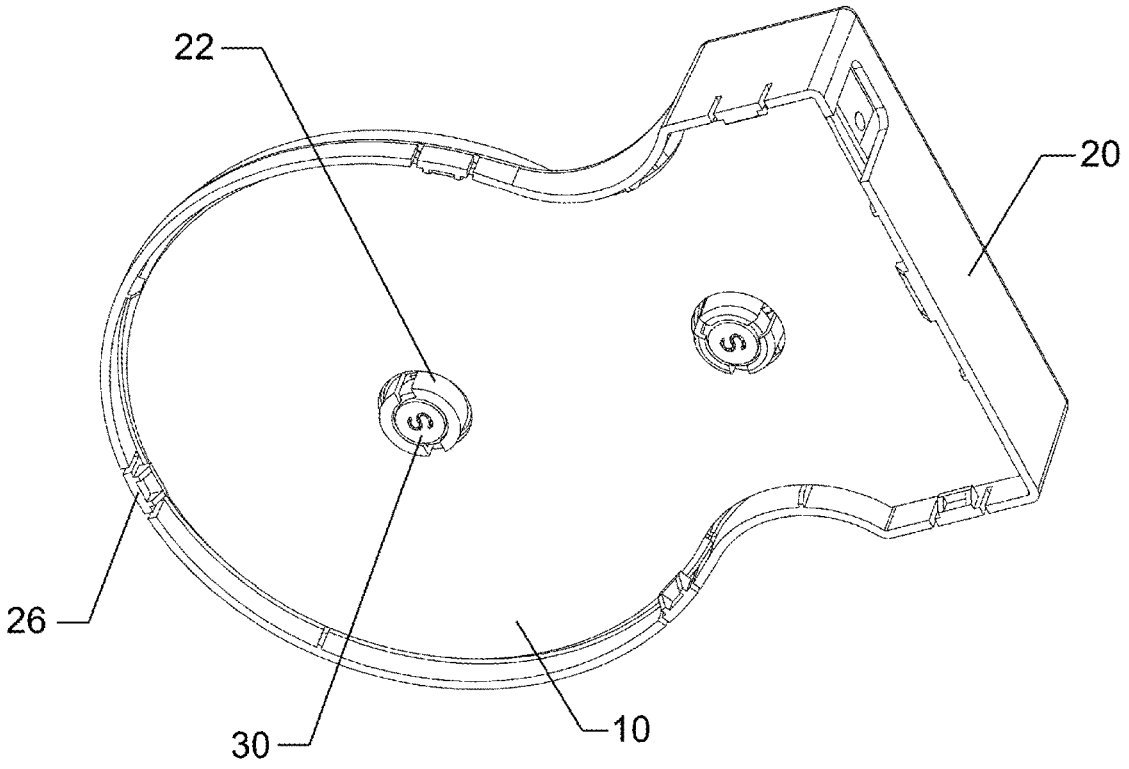
FIG. 2 is a schematic assembly diagram of the LED light source module provided by the first preferred embodiment of the present disclosure.
Figure 4:
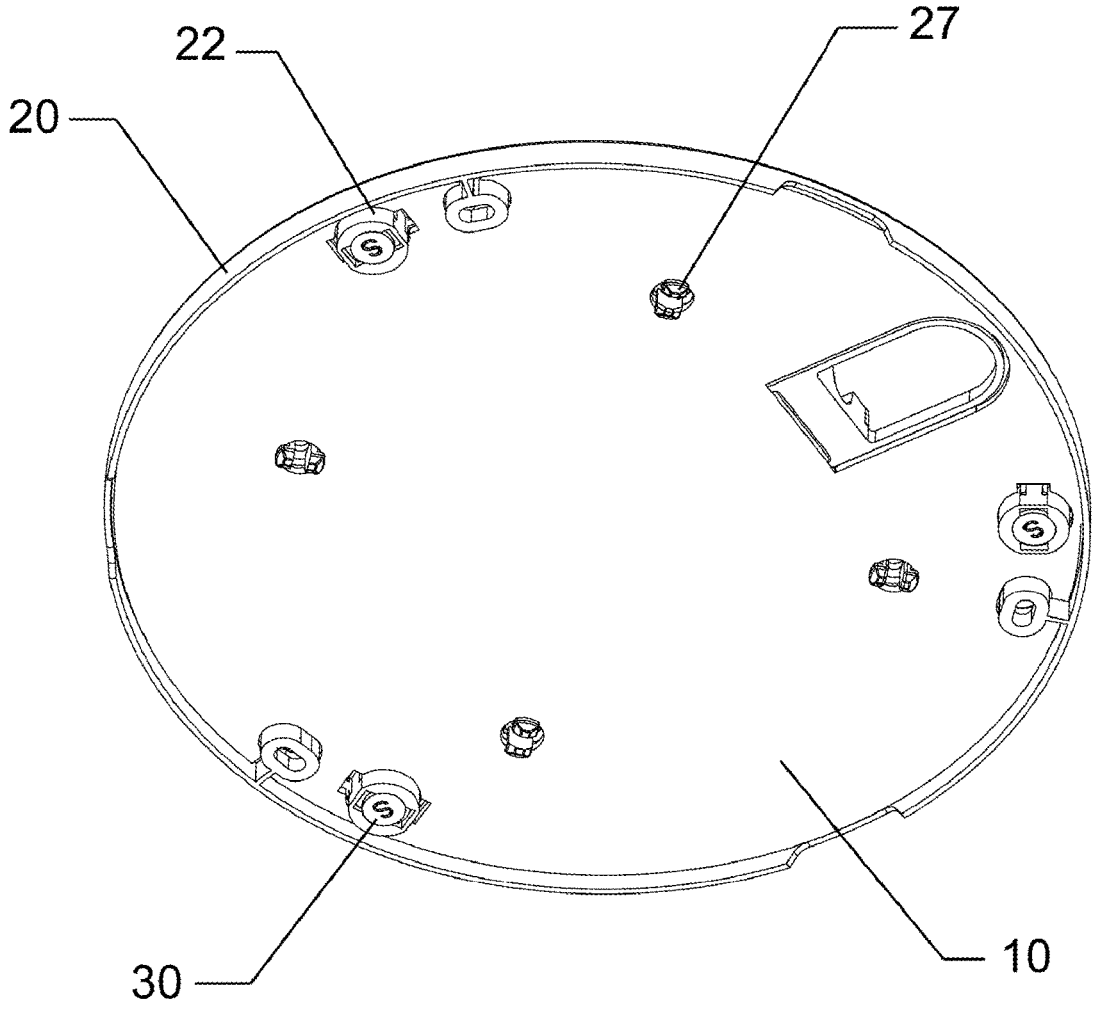
FIG. 4 is a schematic assembly diagram of the LED light source module provided by the second preferred embodiment of the present disclosure.
Figure 5:
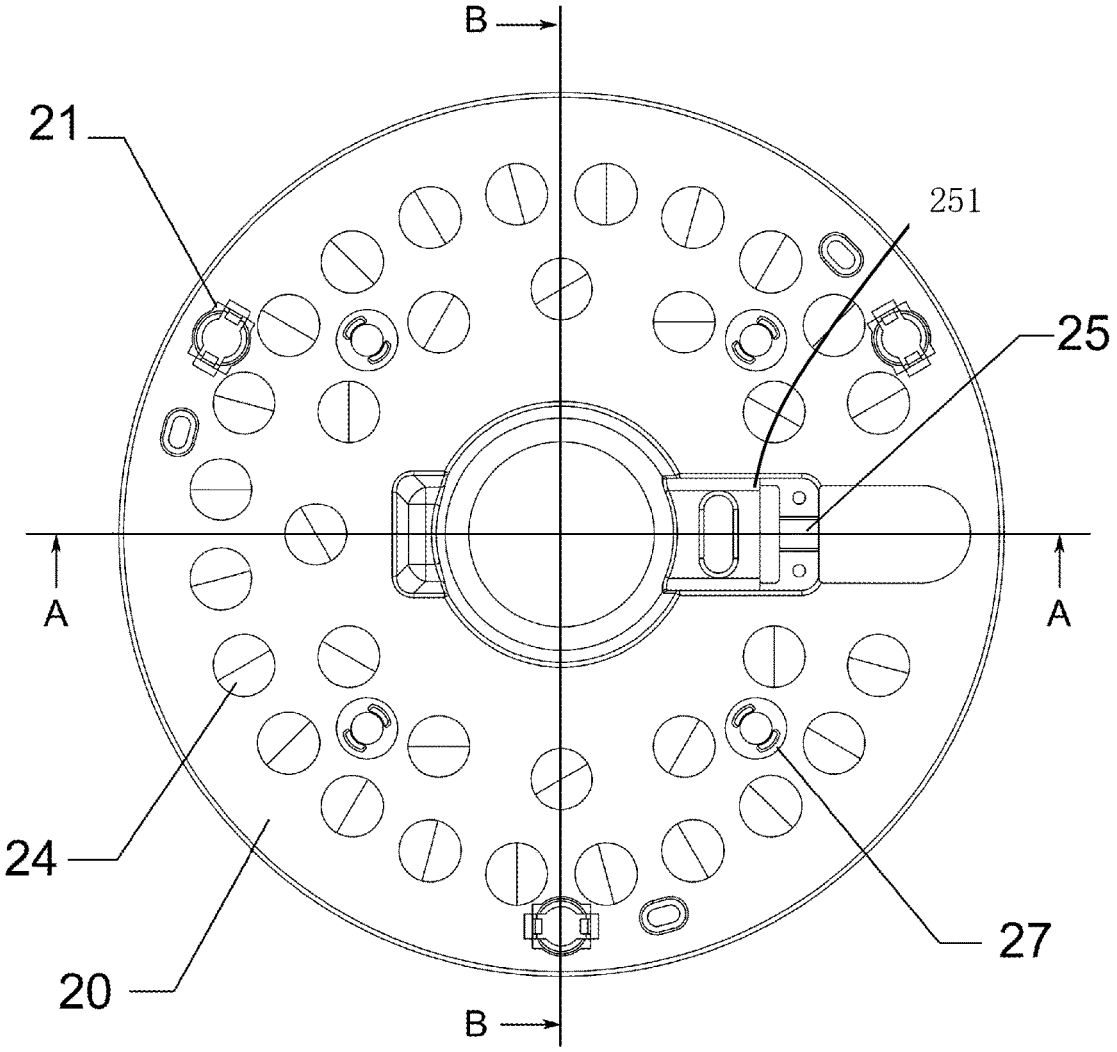
FIG. 5 is a top view of the LED light source module provided by the second preferred embodiment of the present disclosure.
Figure 6:
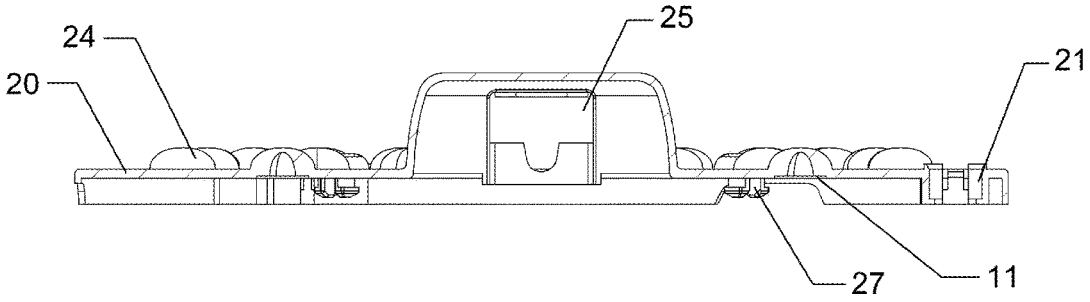
FIG. 6 is an A-A schematic diagram of the embodiment as shown in FIG. 5.
Figure 7:
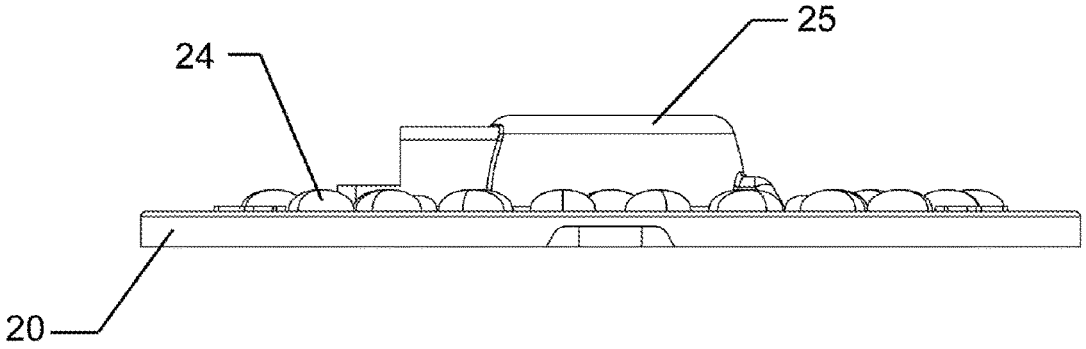
FIG. 7 is a B-B schematic diagram of the embodiment as shown in FIG. 5.

In the present disclosure, the fixing effect of the LED light sources and the lamp can be achieved simply by adoption of the structure of the accommodating portions 21 and the through holes 12 provided on two components of the LED light source module, namely the light source plate 10 and the integrated lens assembly 20, with the magnetic elements 30 being inserted into the accommodating portions 21, and by utilization of magnetic attraction between the magnetic elements 30 and the magnetic base without additional assembling tools (e.g., screws and a screw driver), so that the assembly process can become more convenient. Meanwhile, the light source plate 10 and the magnetic base of the lamp are not isolated from each other by other component(s), and the thermal conductivity of general magnetic materials is also good, so that the thermal radiating effect of the entire lamp is relatively good. As shown in FIGS. 2 and 4, as the accommodating portion 21 includes a fixed end fixed onto the integrated lens assembly 20 and a free end 22 which is extended outward, and both the fixed end and the free end 22 of the accommodating portion are in structures provided with openings, the accommodating portion 21 is of an annular accommodating section, so that the magnetic elements 30 and the magnetic base of the lamp can be attached together, and hence the fixing effect of the LED light sources can be enhanced.

Figure 3:
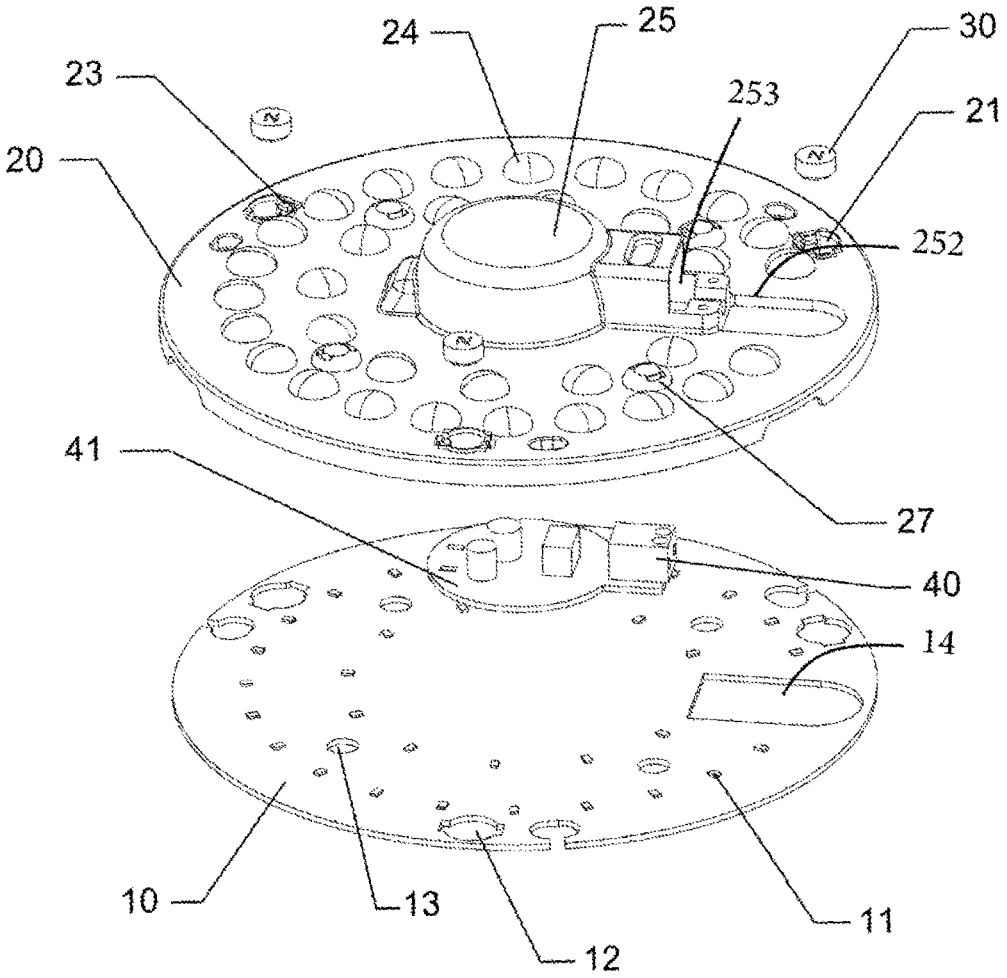
FIG. 3 is a schematic exploded view of an LED light source module provided by a second preferred embodiment of the present disclosure.

As shown in FIGS. 1 and 3, a plurality of fastening stands 23, the height of which is gradually increased from the fixed end to the free end 22, are spaced on an inner wall of each accommodating portion 21; a cut-off end of the fastening stand 23 is higher than an initial end; by adoption of this configuration, a sliding chute guiding the magnetic element 30 to be embedded into the accommodating portion 21 can be formed at the initial end, so that the magnetic element 30 can more conveniently enter the accommodating portion 21; and when the magnetic element 30 slides to the cut-off end, the magnetic element 30 can be restricted at the free end 22 of the accommodating portion 21 by a higher lug boss at the cut-off end, so that the magnetic element 30 cannot be disengaged from the accommodating portion 21 to damage the LED light source in the operation of the lamp. As shown in FIG. 2, an extension end of the accommodating portion 21 may be formed with a plurality of cambered elastic clamping parts; a gap is formed between two adjacent clamping parts and is extended from the cut-off end of the fastening stand 23 to the free end 22 of the accommodating portion 21; and these clamping parts can clamp the magnetic element 30 and cooperate with the fastening stand 23 to fix the magnetic element 30. The magnetic element 30 can be more conveniently detached by adoption of the plurality of cambered elastic clamping parts provided with gaps interposed there between to clamp the magnetic element 30.

In the present disclosure, the integrated lens assembly 20 and the light source plate 10 are fixed by a detachable connection mechanism, so that assembly, disassembly and maintenance can become more convenient.

In various detachable connection fixing means, the first optional fixing means is illustrated in FIGS. 1 to 7, the shape of the integrated lens assembly 20 matches with the shape of the light source plate 10; the integrated lens assembly may be a light transmitting component of a plate shape; a plurality of elastic fasteners 26 extended in the direction towards the light source plate are spaced at the edge of the integrated lens assembly and configured to fasten the light source plate 10; the elastic fasteners 26 may be provided at the encircling part which is entirely extended in the same direction; and by adoption of the encircling part, the integrated lens assembly 20 encircles the entire light source plate 10, has the function of electric shock isolation, and meanwhile protects the light source plate 10. In the first preferred embodiment, the elastic fasteners 26 on an encircling part are provided along the encircling part for encircling the lens setting area and the power supply area.

In the second optional fixing means, the integrated lens assembly 20 is provided with a plurality of pairs of elastic jaws 27 which are extended towards the light source plate 10; the light source plate 10 is provided with clamping holes 13 which are arranged corresponding to the elastic jaws 27; and the elastic jaws 27 run through the clamping holes 13 and clamp the light source plate 10. In the second preferred embodiment, four pair of elastic jaws 27 are adopted, and the elastic jaws 27 are disposed on the lens setting area of the integrated lens assembly 20 to approximately form a square.

The fixing means of adopting the mechanical connecting elements such as the elastic jaws 27 and the elastic fasteners 26 is an exemplary assembly method in consideration of both convenience and reliability. It should be conceived by those skilled in the art that the integrated lens assembly 20 and the light source plate 10 can also be fixed by various other common fixing means, for instance, fixing via a U-shaped clamp plate; the present disclosure only exemplifies two preferred fixing means; and the fixing of the integrated lens assembly 20 and the light source plate 10 by other fixing means shall obviously fall within the scope of protection of the present disclosure.

As shown in FIGS. 1 and 3, an adapter plate 41 is disposed between the power driving module 40 and the light source plate 10. By adoption of the adapter plate 41, the electric connection between the power driving module 40 and the light source plate 10 may be achieved by a connection wire or connection wires, and main bodies of the power driving module and the light source plate can achieve insulating effect and have the function of electric shock protection.

Figure 8:
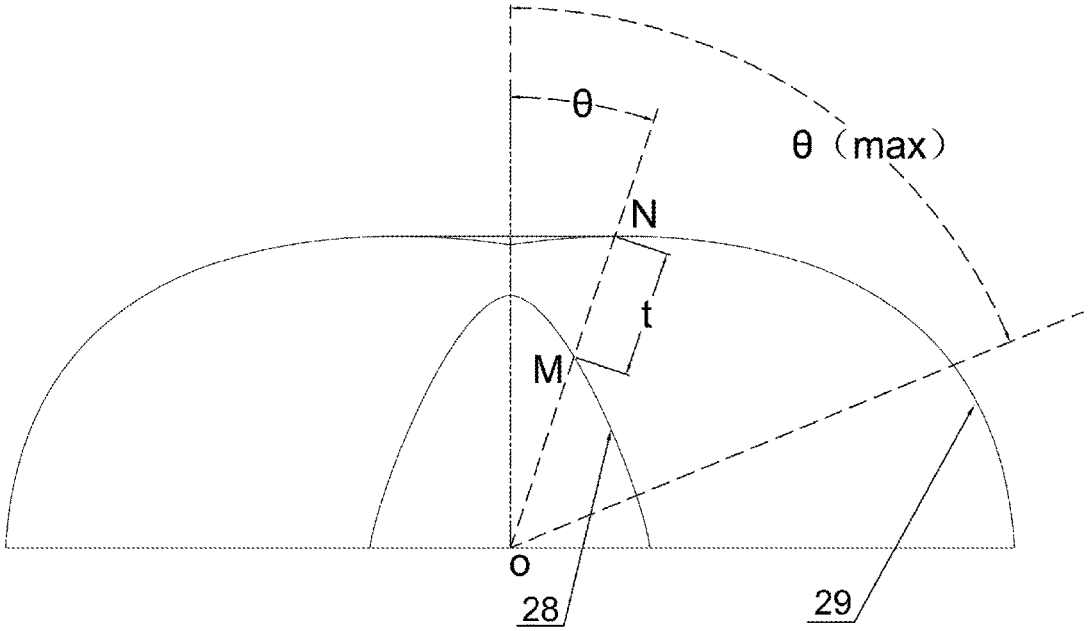
FIG. 8 is a schematic structural view of a lens in the LED light source module provided by the present disclosure.

As shown in FIGS. 1 and 3, the lens unit in the two embodiments of the present disclosure is a hemispherical lens 24 and is arranged in one-to-one correspondence with the LED light source 11. FIG. 8 illustrates the hemispherical lens 24 applicable in the present disclosure. The integrated lens assembly 20 is formed by integrally forming the plurality of hemispherical lenses 24. A central portion of an incident surface 28 of the hemispherical lens 24 is concaved to form an accommodating cavity configured to accommodate the LED light source 11 and axisymmetric relative to the hemispherical lens 24. By adoption of the configuration, the incident surface 28 can maximally receive light emitted by the LED light source 11. In addition, a single LED generally adopts 120 DEG Lambert emission; the spacing between two LEDs is formed to allow uniform light to be obtained on a light-emitting surface after the mixing of light; by adoption of the lens, the luminous angle of the LED can be further expanded; and as shown in FIG. 8, the light is deviated towards the direction further away from an optical axis after been refracted two times, so that the requirement of uniform light emission can be satisfied even at lower height, and hence the height of the lamp can be reduced and ultrathin lamp can be obtained.

As shown in FIG. 8, a light-emitting surface 29 of the hemispherical lens 24 is not a regular hemispherical structure but an approximate ellipsoid structure. Because the accommodating cavity is concavely formed on the incident surface 28, the hemispherical lens 24 is of a structure with a thinner central portion and two thicker sides. A straight line having an included angle $\theta$ with the optical axis is led from an origin O of the lens and respectively intersects with the incident surface 28 and the light-emitting surface 29 of the lens; intersection points are respectively M and N; the length of the line segment MN is the thickness t of the lens; and the thickness t of the lens is monotonously progressively increased along with the increase of $\theta$ within the range $0 \leq \theta \leq \theta(\max)$, in which $\theta(\max)$ is ranged from 45° to 90°. Due to the configuration of the hemispherical lens 24, an included angle between paraxial light and the optical axis is increased after the paraxial light runs through the incident surface, and is further increased after the paraxial light runs through the light-emitting surface, so that the hemispherical lenses 24 can have better diffusion effect, and meanwhile, the problem of large paraxial light intensity of the LED light sources can be solved and more uniform flood lighting can be achieved.

As shown in FIG. 8, the central portion of the light-emitting surface 29 of the hemispherical lens 24 is concaved to form an inverted-cone diffusion portion. The light diffusion function can be achieved by increasing the refraction angle when the light is emitted from the light-emitting surface 29 due to the increasing of the incidence angle when the light is projected to the light-emitting surface 29.

In the present disclosure, the incident surface 28 and the light-emitting surface 29 of the hemispherical lens 24 may further be subjected to surface treatment, and the incident surface 28 and the light-emitting surface 29 are respectively treated to form a polished surface and a frosted surface. The function of light diffusion and light uniformity can be achieved by utilization of the scattering properties of the frosted surface.

The present disclosure further discloses an LED lamp, which includes a base taken as a mounting base and the LED light source module having the structure as described above.

The LED lamp has the advantages such as simple process, easy assembly, and safety and reliability.

The lens units in the LED lamp provided by the present disclosure are integrated to form the integrated lens assembly 20 which covers the outside of the entire light source plate 10 and has the function of electric shock protection. Meanwhile, the principle of mutual attraction between magnetic objects is also utilized; the plurality of accommodating portions 21 are extended outward on the integrated lens assembly 20; the through holes 12 are formed at positions of the light source plate 10 corresponding to the accommodating portions 21; and meanwhile, the magnetic elements 30 are fixed within the accommodating portions 21. The integrated lens assembly 20 and the light source plate 10 are fixedly connected by a detachable connection mechanism such as elastic fasteners 26 and elastic jaws 27 at first, and then fixed by means of the magnetic force of the magnetic elements 30 fixed within the accommodating portions 21 and the magnetic base of the lamp, so that the entire integrated lens assembly 20 and the light source plate 10 can be fixed on the magnetic base of the lamp. The LED lamp adopting the above fixing structure has a very easy assembly process. Moreover, due to the further cooperation of the magnetic elements 30 and/or the elastic fasteners 24 and/or the elastic jaws 25, the structure of the LED lamp is very safe and reliable. Therefore, the LED lamp is an LED lamp having the advantages of simple process, convent assembly and safety and reliability.

The present disclosure discloses embodiments that are sample in structure, easy to assemble and are safe and reliable, have a simple and convenient production process, and have high production efficiency.

The first aspect of the present disclosure discloses an LED light source module. The module may include: a light source plate comprising a first surface and a second surface which are opposite to each other, in which a plurality of LED light sources are attached to the first surface, and the second surface faces a base assembled on a mounting base; a power driving module electrically connected with the light source plate; and an integrated lens assembly configured to be fixed with the light source plate. The integrated lens assembly may cover an outside of the first surface of the light source plate, and may be provided with a plurality of lens units which may respectively cover an outside of corresponding LED light sources, and may be provided with an accommodating space which may be configured to accommodate the power driving module into the accommodating space.

Preferably, the integrated lens assembly may include a lens setting area and a power supply accommodating area provided with the accommodating space; the lens setting area is disposed at the first height; the power supply accommodating area is formed with being projected upwards from the first height; and a top surface of the power supply accommodating area is disposed at the second height. More preferably, the light source plate includes a light source setting area and a power supply area which respectively correspond to the integrated lens assembly; the lens setting area covers the light source setting area; and the power supply area and the power supply accommodating area accommodate the power driving module together. Optionally, the power supply accommodating area is disposed on one side of the lens setting area, and the power supply area is disposed on one side of the light source setting area. Optionally, the power supply accommodating area is disposed in the middle part of the lens setting area, and the power supply area is disposed in the middle part of the light source setting area.

Preferably, a plurality of magnetic elements and/or mechanical connecting elements run through the integrated lens assembly and the light source plate and are adsorbed and/or assembled on the base. More preferably, a plurality of magnetic elements and/or mechanical connecting elements are concentrically spaced on a central portion and/or a body portion and/or an edge portion of the integrated lens assembly; and the light source plate is correspondingly provided with through holes of a shape matching the magnetic elements and/or the mechanical connecting elements to run through and to be fixed.

Preferably, the integrated lens assembly and the light source plate are fixed by a detachable connection mechanism. Optionally, a shape of the integrated lens assembly matches a shape of the light source plate, and a plurality of elastic fasteners extended in the direction towards the light source plate are spaced at the edge of the integrated lens assembly and configured to fasten the light source plate. Optionally, the integrated lens assembly is provided with a plurality of pairs of elastic jaws extended towards the light source plate; the light source plate is provided with clamping holes corresponding to the elastic jaws; and the elastic jaws run through the clamping holes to clamp the light source plate.

Preferably, an adapter plate is disposed between the power driving module and the light source plate.

Preferably, the lens unit is a hemispherical lens, and a central portion of an incident surface of the hemispherical lens is concaved to form an accommodating cavity configured to accommodate an LED light source and axisymmetric relative to the hemispherical lens. More preferably, the central portion of a light-emitting surface of the hemispherical lens is concaved to form an inverted-cone diffusion portion. More preferably, one of the incident surface and the light-emitting surface is a polished surface and the other is a frosted surface.

The second aspect of the present disclosure discloses an LED lamp, which may include a base taken as a mounting base, and the LED lamp may include the foregoing LED light source module.

By adoption of the above technical proposals, compared with the state of art, the present disclosure has the following advantages:

1. The lens units in the LED lamp provided by the present disclosure are integrated, cover the outside of the entire light source plate, and have the function of electrical shock protection.

2. The LED lamp provided by the present disclosure has a very easy assembly process. The entire assembly process can conducted only by embedding the magnetic elements into the accommodating portions, fastening the lens assembly and the light source plate, and bonding the lens assembly and the light source plate to the base of the lamp. Moreover, the entire lamp is safe and reliable.

3. The radiating effect of the LED lamp provided by the present disclosure is not affected. The magnetic elements run through the through holes embedded into the lens assembly and the light source plate. To a certain extent, the magnetic elements run through the entire light-emitting module, so that the contact area of the light source plate and the base of the lamp or the diffusion portions can be maximized, and hence the thermal radiating effect of the LED lamp can be guaranteed when ensuring easy assembly.

The present disclosure may include dedicated hardware implementations such as application specific integrated circuits, programmable logic arrays and other hardware devices. The hardware implementations can be constructed to implement one or more of the methods described herein. Applications that may include the apparatus and systems of various examples can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the computing system disclosed may encompass software, firmware, and hardware implementations. The terms "module," "sub-module," "unit," or "sub-unit" may include memory (shared, dedicated, or group) that stores code or instructions that can be executed by one or more processors.

It should be noted that the embodiments of the present disclosure have better implementations, are not intended to limit the present disclosure in any way, and may be changed or modified into equivalent valid embodiments by those skilled in the art by utilization of the foregoing disclosed technical contents; and any modification or equivalent change and improvement made to the above embodiments on the basis of the technical essence of the present disclosure without departing from the content of the technical proposals of the present disclosure shall still fall within the scope of the technical proposals of the present disclosure.

What is claimed is:

1. A light-emitting diode (LED) light source module, configured to be disposed in an LED lamp and for lighting, comprising:

a light source plate comprising a first surface and a second surface which are opposite to each other, in which a plurality of LED light sources are attached to the first surface, and the second surface faces a base assembled on a mounting base of the LED lamp;

a power driving module electrically connected with the light source plate; and an integrated lens assembly configured to be fixed with the light source plate, wherein the integrated lens assembly is at least partially bonded to and covers an outside of the first surface of the light source plate and is provided with a plurality of lens units which respectively cover an outside of corresponding LED light sources;

the integrated lens assembly is provided with an accommodating space, and the power driving module is accommodated into the accommodating space; and a plurality of magnetic elements are assembled to the integrated lens assembly and are adsorbed and/or assembled on the base.

2. The LED light source module according to claim 1, wherein the integrated lens assembly comprises a lens setting area and a power supply accommodating area provided with the accommodating space;

the lens setting area is disposed at a first height of the integrated lens assembly; and the power supply accommodating area is formed with being projected upwards from the first height, and a top surface of the power supply accommodating area is disposed at a second height.

3. The LED light source module according to claim 2, wherein the light source plate comprises a light source setting area and a power supply area which correspond to the integrated lens assembly respectively;

the lens setting area covers the light source setting area; and the power supply area and the power supply accommodating area accommodate the power driving module together.

4. The LED light source module according to claim 3, wherein the power supply accommodating area is disposed on one side of the lens setting area; and the power supply area is disposed on one side of the light source setting area.

5. The LED light source module according to claim 3, wherein the power supply accommodating area is disposed in a middle part of the lens setting area; and the power supply area is disposed in a middle part of the light source setting area.

6. The LED light source module according to claim 2, wherein the integrated lens assembly further includes a tail portion adjacent to the power supply accommodating area;

a height of the tail portion is lower than the second height where the power supply accommodating area is provided; and the tail portion is configured to accommodate and clamp a wire electrically connected with the power driving module.

7. The LED light source module according to claim 6, wherein the tail portion is overlapped with the light source plate and provided with an opening for a screw to clamp the wire between the tail portion and the light source plate.

8. The LED light source module according to claim 7, wherein the integrated lens assembly and the light source plate are respectively provided with notches, which communicate with each other, close to the tail portion.

9. The LED light source module according to claim 1, wherein a plurality of magnetic elements are concentrically spaced on a central portion and/or a body portion and/or an edge portion of the integrated lens assembly; and the light source plate is correspondingly provided with through holes of a shape matching the magnetic elements to run through and to be fixed.

10. The LED light source module according to claim 1, wherein the integrated lens assembly and the light source plate are fixed by a detachable connection mechanism.

11. The LED light source module according to claim 10, wherein a shape of the integrated lens assembly matches a shape of the light source plate; and a plurality of elastic fasteners extended in a direction towards the light source plate are spaced at an edge of the integrated lens assembly and configured to fasten the light source plate.

12. The LED light source module according to claim 10, wherein the integrated lens assembly is provided with a plurality of pairs of elastic jaws extended towards the light source plate; the light source plate is provided with clamping holes corresponding to the elastic jaws; and the elastic jaws run through the clamping holes to clamp the light source plate.

13. The LED light source module according to claim 1, wherein an adapter plate is disposed between the power driving module and the light source plate.

14. The LED light source module according to claim 1, wherein the lens unit is a hemispherical lens; and a central portion of an incident surface of the hemispherical lens is concaved to form an accommodating cavity configured to accommodate an LED light source and axisymmetric relative to the hemispherical lens.

15. The LED light source module according to claim 14, wherein a central portion of a light-emitting surface of the hemispherical lens is concaved to form an inverted-cone diffusion portion.

16. The LED light source module according to claim 14, wherein one of the incident surface and the light-emitting surface is a polished surface and the other is a frosted surface.

17. Alight emitting diode (LED) lamp, comprising the LED light source module according to claim 1, wherein the LED light source module is adsorbed and assembled on the base.

18. A light emitting diode (LED) light source module, disposed in an LED lamp and used for lighting, comprising:

a light source plate comprising a first surface and a second surface which are opposite to each other, in which a plurality of LED light sources are attached to the first surface, and the second surface faces a base assembled on a mounting base of the LED lamp;

a power driving module electrically connected with the light source plate; and an integrated lens assembly configured to be fixed with the light source plate; and at least two magnetic elements assembled into the integrated lens assembly, in which the integrated lens assembly is at least partially bonded to and covers an outside of the first surface of the light source plate and is provided with a plurality of lens units which respectively cover an outside of corresponding LED light sources; the integrated lens assembly is provided with an accommodating space, and the power driving module is accommodated to the accommodating space; the integrated lens assembly is provided with accommodating portions which are extended; and the at least two magnetic elements are at least partially accommodated into the accommodating portions.

19. The LED light source module according to claim 18, wherein the integrated lens assembly further includes a tail portion adjacent to a power supply accommodating area;

a height of the tail portion is lower than a second height where the power supply accommodating area is provided; and the tail portion is configured to accommodate and clamp a wire electrically connected with the power driving module.

20. The LED light source module according to claim 19, wherein the tail portion is overlapped with the light source plate and provided with an opening for a screw to clamp the wire between the tail portion and the light source plate.

21. The LED light source module according to claim 20, wherein the integrated lens assembly and the light source plate are respectively provided with notches, which communicate with each other, close to the tail portion.

* * * * *